US006123586A

United States Patent [19]

MacDougall

[11] Patent Number: 6,123,586

[45] Date of Patent: Sep. 26, 2000

[54] MODULAR CONNECTOR

[75] Inventor: Alan R. MacDougall, Palm Beach, Fla.

[73] Assignee: Hon Hai Precision Ind. Co., Ltd., Taipei Hsien, Taiwan

[21] Appl. No.: 09/366,381

[22] Filed: Aug. 3, 1999

[51] Int. Cl.[7] ..... H01R 13/502

[52] U.S. Cl. ..... 439/701; 439/731; 439/79

[58] Field of Search ..... 439/701, 608, 439/717, 79, 731

[56] References Cited

U.S. PATENT DOCUMENTS

| | | | |
|---|---|---|---|
| 4,737,113 | 4/1988 | Hopper et al. | 439/701 |
| 5,066,236 | 11/1991 | Broeksteeg | 439/608 |
| 5,104,341 | 4/1992 | Gilissen et al. | 439/608 |
| 5,141,453 | 8/1992 | Fusselman et al. | 439/608 |
| 5,236,375 | 8/1993 | Kachlic | 439/701 |
| 5,354,219 | 10/1994 | Wanjura | 439/701 |
| 5,664,968 | 9/1997 | Mickievicz | 439/608 |
| 5,795,191 | 8/1998 | Preputnick et al. | 439/608 |

*Primary Examiner*—Gary F. Paumen
*Attorney, Agent, or Firm*—Wei Te Chung

[57] ABSTRACT

A modular connector comprises an insulative mother housing defining rows of passageways through opposite sides thereof. A plurality of modules each have contacts extending therefrom for connection to the passageways of the mother housing. Each module defines a reception hole so that all the reception holes of all the modules are in alignment with each other when the modules are connected to the mother housing by the extended contacts thereof. A dowel is adapted to be inserted into the reception holes of at least two adjacent modules thereby connecting the at least two adjacent modules in addition to the connection thereof to the mother housing.

8 Claims, 7 Drawing Sheets

MODULAR CONNECTOR

BACKGROUND OF THE INVENTION

1. Field of The Invention

The present invention relates to a modular connector including a plurality of modules connected to a housing, especially to a modular connector having reinforced means for simultaneously fixing at least two adjacent modules in position.

2. The Prior Art

Future bus connectors have been used in electrical connection between a backplane and several daughter boards. Normally, a modular plug connector is connected to the backplane and a complementary modular receptacle connector is connected to the daughter board. A plurality of receptacle pins are retained in the modular receptacle connector for receiving pins extending from the modular plug connector thereby electrically connecting the daughter board to the backplane. U.S. Pat. No. 5,066,236 has disclosed a modular receptacle connector having a plurality of modules fixed to a housing and each module has right angle receptacle pins insert molded therein. The modules fixed at two ends of the connector are apt to be impacted by hands or tools during assembly of the modular connector to the module plug connector thereby affecting the positioning thereof and further affecting the electrical contacting between the receptacle connector and the plug connector.

It is requisite to provide an improved modular connector having reinforced means for better fixing the modules at two ends of the connector so that even when the modular connector is impacted by hands or other objects, the related modules still remains in position.

SUMMARY OF THE INVENTION

The primary purpose of the present invention is to provide an improved modular connector which provides extra interconnection between adjacent modules in addition to a common connection to a housing thereby guaranteeing a reliable positioning of the modules.

In accordance with one aspect of the present invention, a connector module comprises an insulative first half housing having a boss extending from an inner surface thereof and a reception hole defined through an axis of the boss. An insulative second half housing has a plurality of contact reception grooves defined in an inner surface thereof, and a reception hole defined separately from the contact reception grooves for forcibly receiving the boss of the first half housing. A set of right angle contacts each comprise a soldering tail portion connected to an intermediate portion connected to a mating portion, wherein the intermediate portions of the contacts are received in the contact reception grooves of the second half housing, while the mating portions and the soldering tail portions respectively extend out from adjacent sides of the second half housing.

In accordance with another aspect of the present invention, a modular connector comprises an insulative mother housing defining rows of passageways through opposite sides thereof. A plurality of modules each have contacts extending therefrom for connection to the passageways of the mother housing. Each module defines a reception hole so that all the reception holes of all the modules are in alignment with each other when the modules are connected to the mother housing by the extended contacts thereof. A dowel is adapted to be inserted into the reception holes of at least two adjacent modules thereby connecting the at least two adjacent modules in addition to the connection thereof to the mother housing.

DETAILED DESCRIPTION OF THE PREFERRED EMBODIMENT

Figure 1:
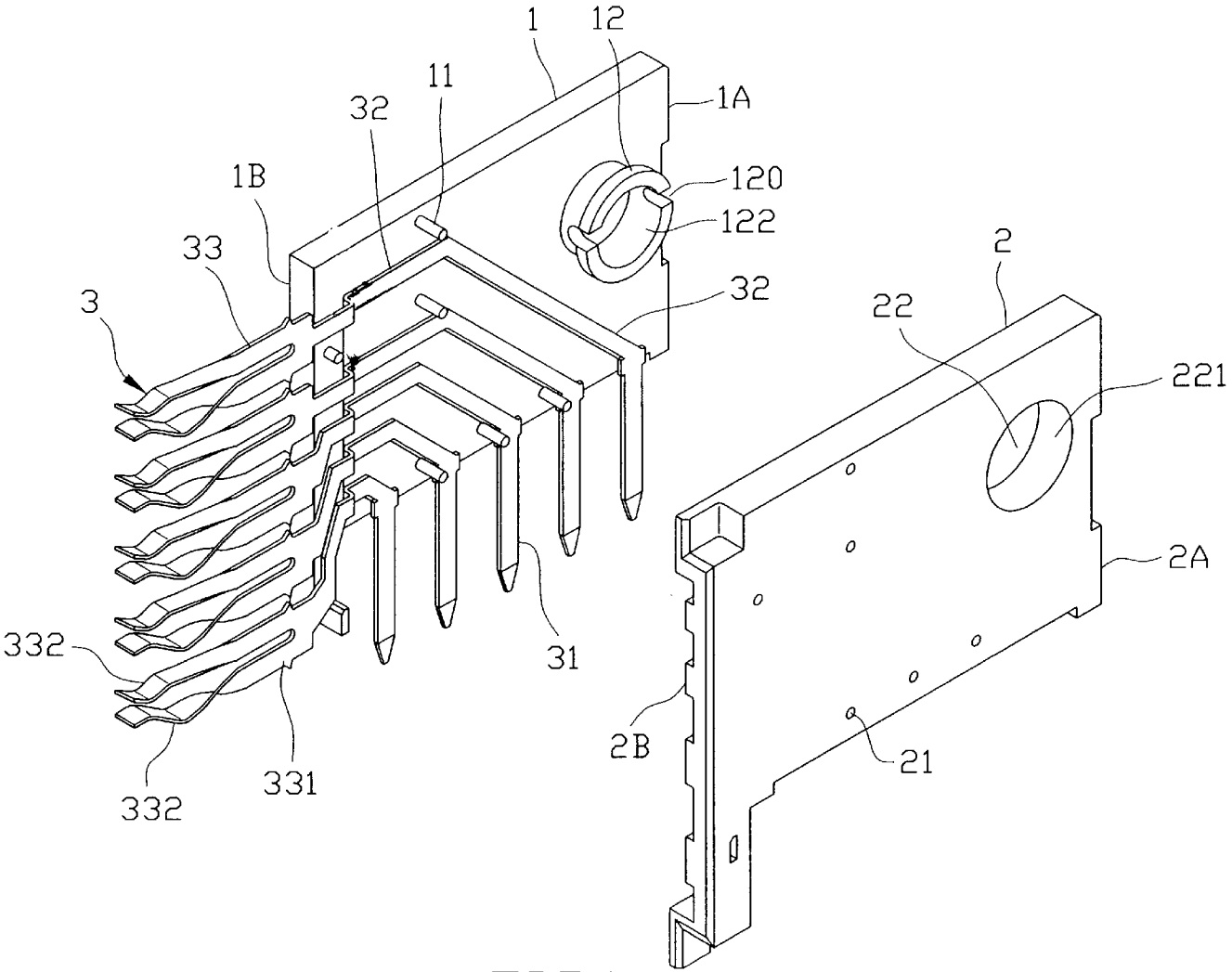
FIG. 1 is an exploded view of a module used in the present invention.
Figure 5:
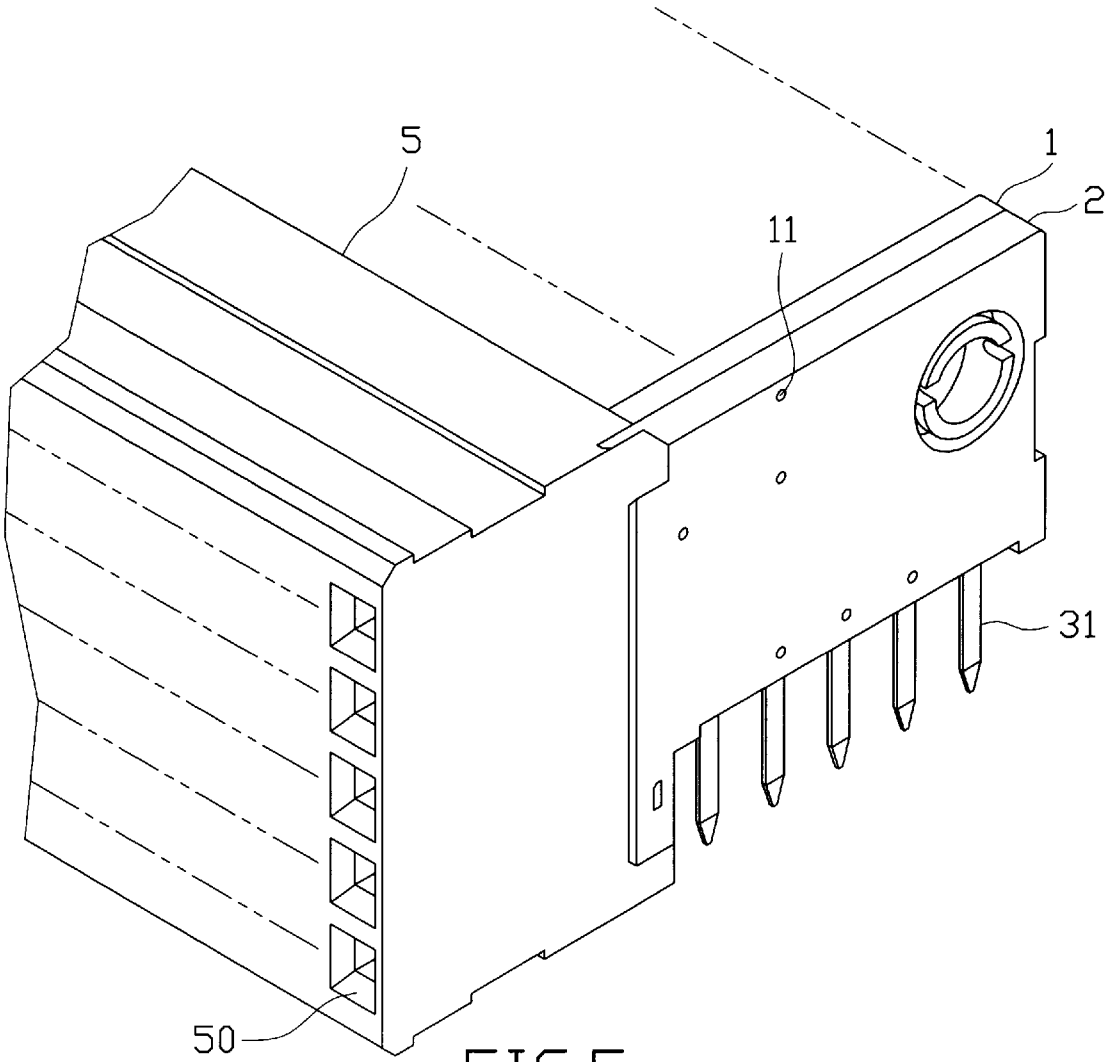
FIG. 5 is a perspective view showing the module of FIG. 2 being connected to a housing.

Referring to FIG. 1, a module in accordance with the present invention comprises an insulative first half housing 1, an insulative second half housing 2 adapted to be engaged with the first half housing 1, and a set of right angle contacts 3 retained between the first half housing 1 and the second half housing 2. The right angle contacts 3 each include a solder tail portion 31 adapted to be soldered on a daughter board (not shown), an intermediate portion 32 connected to the solder tail portion 31, and a mating portion 33 connected to the intermediate portion 32 and having two contacting beams 332 for electrically receiving an inserted pin (not shown) of a plug connector (not shown). Each contact 3 has identical solder tail portion 31 and mating portion 33. The only difference between each contact 3 is the length of the intermediate portion 32. Each beam 332 of the mating portion 33 of the contact 3 has a barb 331 formed at one side thereof for interferentially engaging with a mother housing 5 (FIG. 5).

Figure 3:
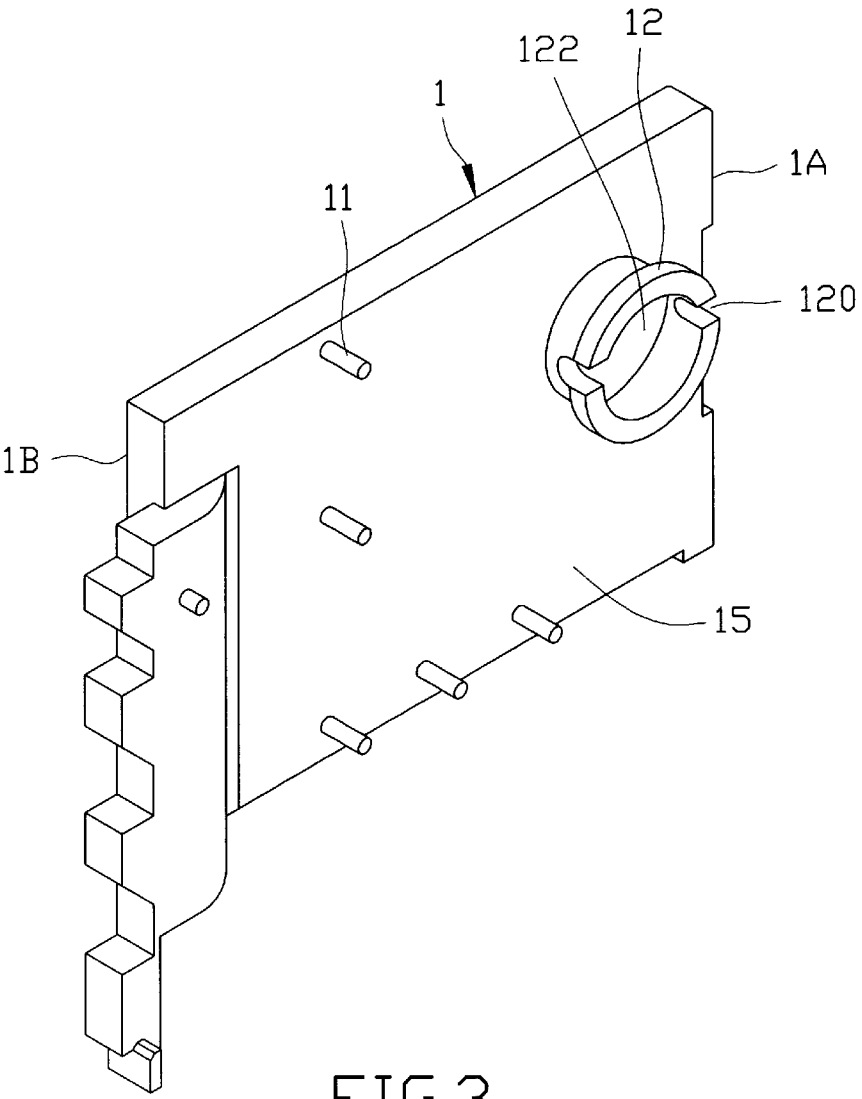
FIG. 3 is a perspective view of a first half housing shown in FIG. 1.

Also referring to FIG. 3, the first half housing 1 has a first side 1A and a second side 1B, wherein the intersection between the intermediate portion 32 and the mating portion 33 of each contact 3 is substantially positioned in the second side 1B of the first half housing 1. A plurality of engaging protrusions 11 extend from an inner surface 15 of the first half housing 1. A boss 12 extends from the same inner face of the first half housing 1 near the first side 1A and defines a reception hole 122 therein. Two cutouts 120 are defined oppositely in the periphery of the boss 12.

Figure 4:
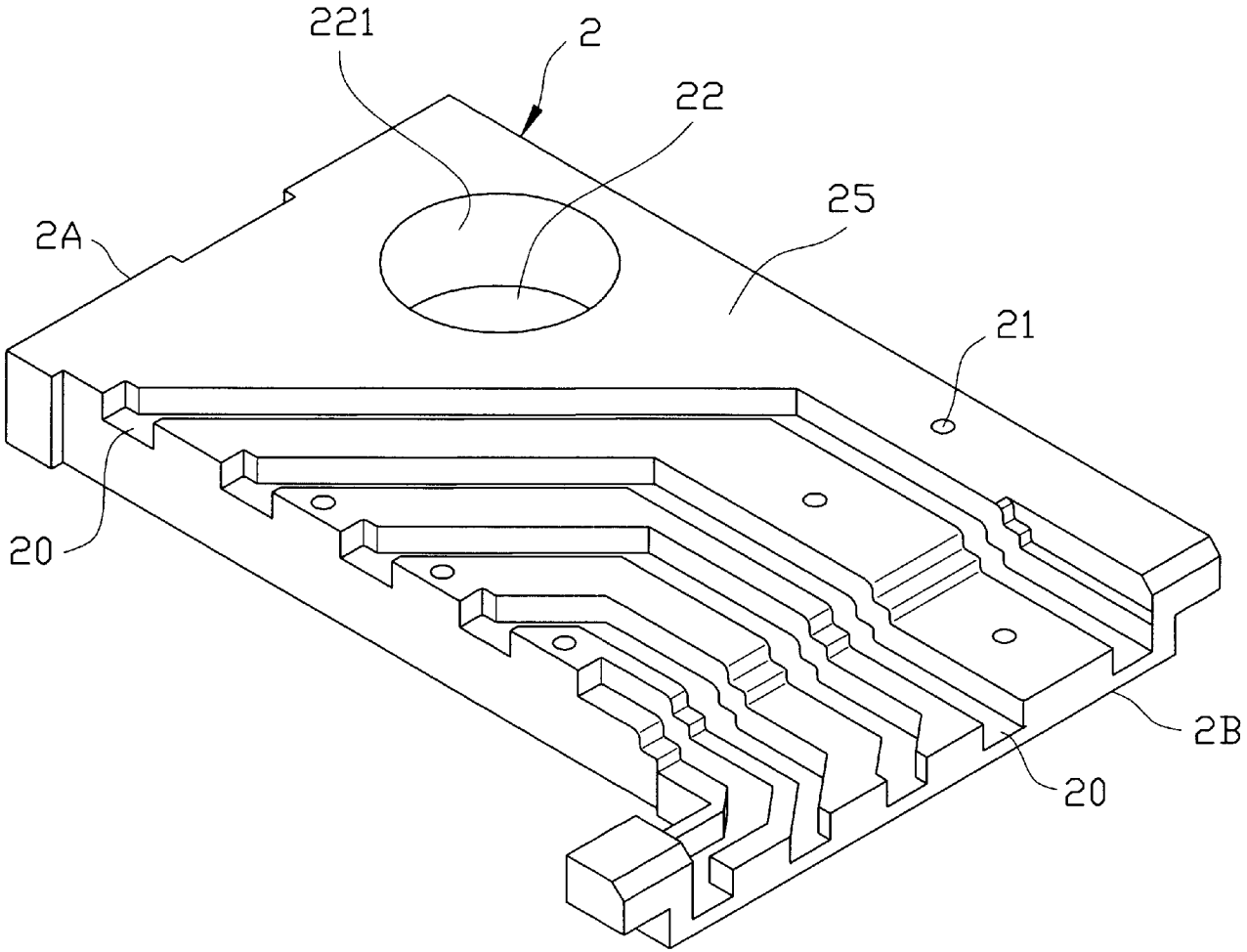
FIG. 4 is a perspective view of a second half housing shown in FIG. 1.

Also referring to FIG. 4, the second half housing 2 has a first side 2A and a second side 2B opposite the first side 2A and a relatively large hole 22 formed near the first side 2A. A plurality of contact reception grooves 20 are defined in an inner surface 25 of the second half housing 2 for receiving the intermediate portions 32 of the contacts 3. A plurality of relatively small holes 21 are defined in the second half housing 2 for receiving the engaging protrusions 11 of the first half housing 1 when the two housings 1, 2 are engaged with each other. An inner flange 221 is formed in inner periphery of the relatively large hole 22 preventing the boss 12 from releasing from the hole 22 after the boss 12 of the first half housing 1 is forcedly received in the hole 22 of the second half housing 2. The second half housing 2

Figure 2:
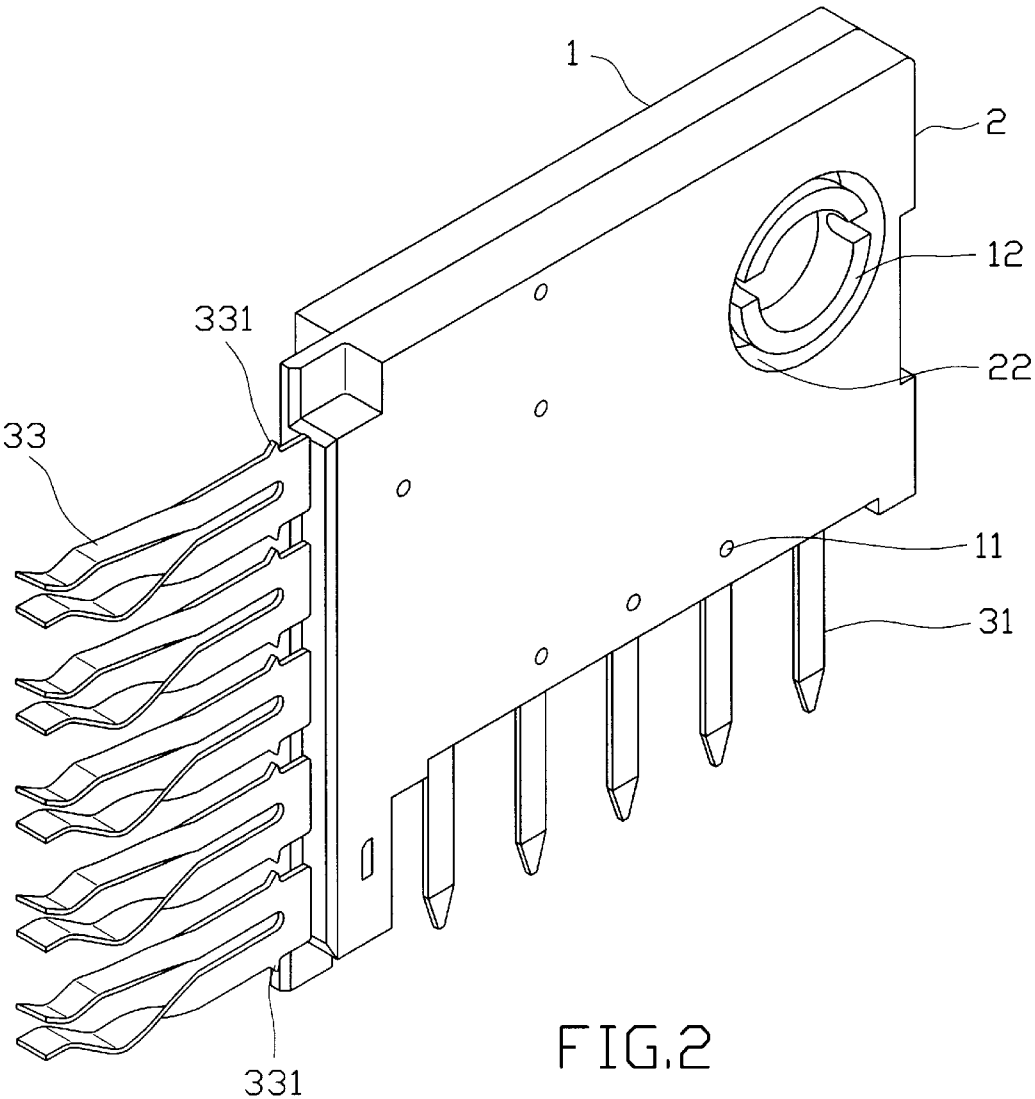
FIG. 2 is an assembled view of FIG. 1.

Also referring to FIG. 2, the first half housing 1, the set of contacts 3, and the second half housing 2 are assembled, and the intermediate portions 32 of the contacts 3 are positioned in the contact reception grooves 20 of the second half housing 2, the engaging protrusions 11 of the first half housing 1 are forcibly received in the relatively small holes 21 of the second half housing 2, the boss 12 of the first half housing 1 is forcibly received in the relatively large hole 22 of the second half housing 2, the first side 1A of the first half housing 1 is in alignment with the first side 2A of the second half housing 2, and the second side 1B of the first half housing 1 is in alignment with the second side 2B of the second half housing 2. The cutouts 120 of the boss 12 allow it to be forcibly inserted through the inner flange 221 of the relative large hole 22 via deformation. The inner flange 221 prevents the boss 12 from separating from the hole 22 after the boss 12 has been forcibly inserted into the hole 22.

Figure 6:
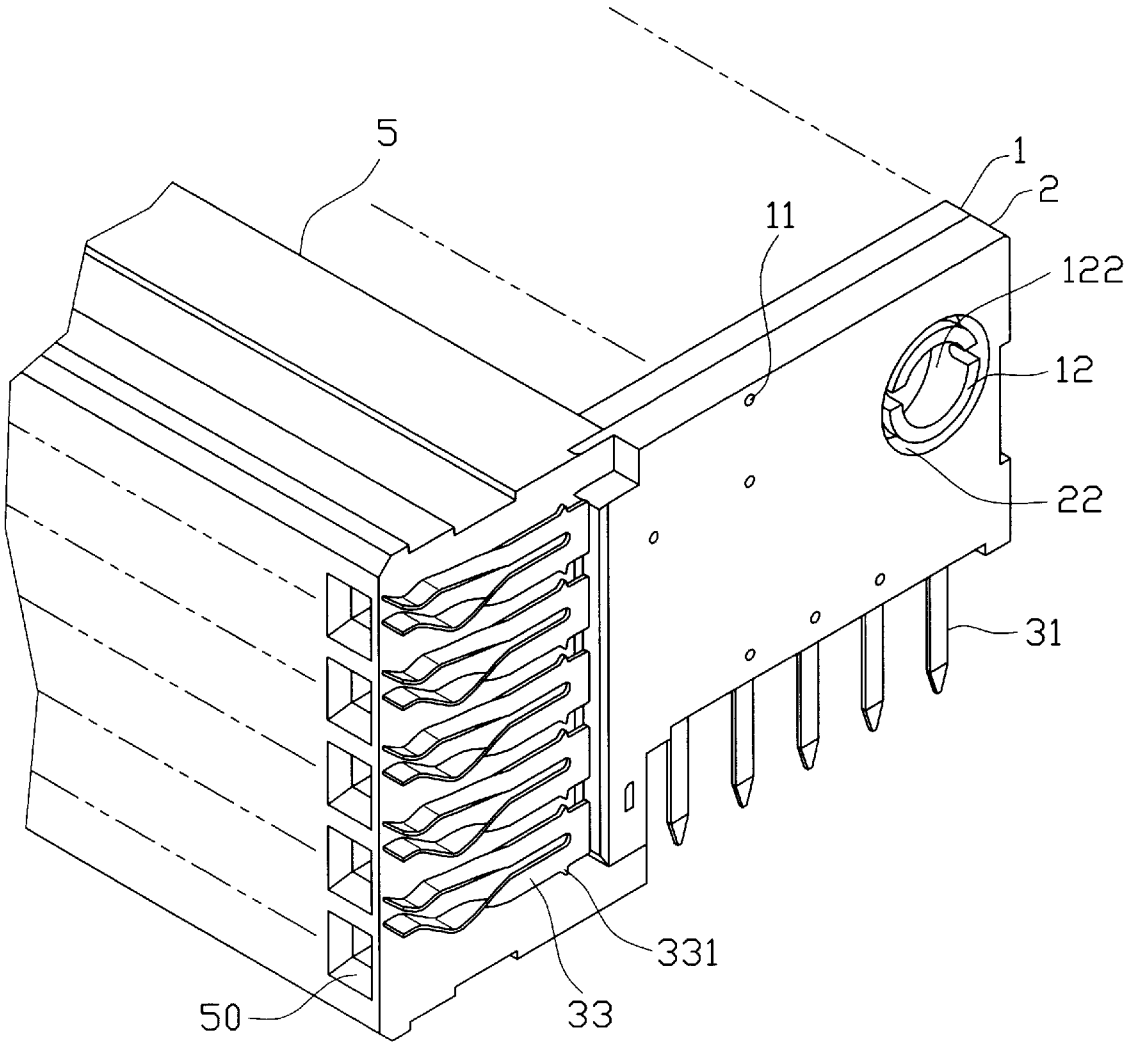
FIG. 6 is a view similar to FIG. 5, with the mating portions of the contacts inserted into the housing being particularly shown.

Referring to FIG. 5, a plurality of the modules of FIG. 2 may be connected to a mother housing 5 to constitute a modular connector. For clarity, herein only one module is shown. The mother housing 5 defines a matrix of passageways 50, and only a row is shown for simplicity. Referring to FIG. 6, each module is fixed to the mother housing 5 partially by the engagement of the second sides 1B, 2B of the half housings 1, 2 with a rear face of the mother housing 5 and partially by the engagement of the barbs 331 of the mating portions 33 of the contacts 3 with internal periphery of the corresponding passageways 50 of the mother housing 5. Since, the engagement between the module and the mother housing 5 is well known, it will not be described in detail herein.

Figure 7:
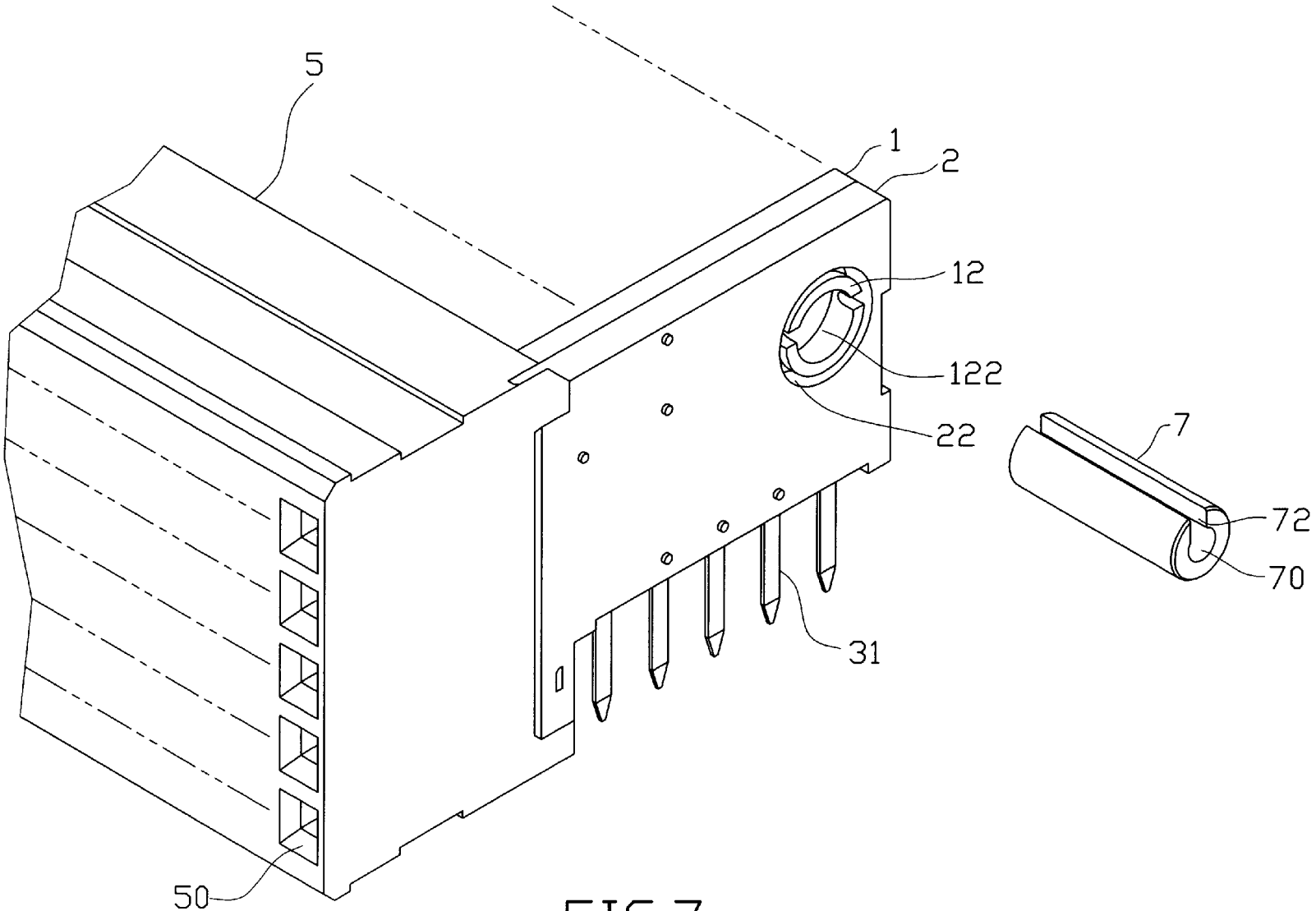
FIG. 7 is a perspective view of a dowel adapted to be inserted into the reception holes of adjacent modules in two ends of the modular connector.

Referring to FIG. 7, a dowel 7 having a hollow cylinder structure is used to engage with at least two adjacent modules by the reception holes 122 thereof. The dowel 7 defines a hole 70 along an axis thereof and a longitudinal cutout 72 communicating with the hole 70. The cutout 72 of the dowel 7 allows the dowel 7 to be minimized in its radius thereby facilitating insertion thereof into the reception holes 122 of adjacent modules. The lengths of the dowel 7 may be made different so the shorter dowel may link two modules while the longer dowel may link three or more modules. For example, the length of the dowel 7 shown in FIG. 7 may link three modules.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A connector module comprising:

an insulative first half housing having a boss extending from an inner surface thereof and a reception hole defined through an axis of the boss;

an insulative second half housing having a plurality of contact reception grooves defined in an inner surface thereof, and a reception hole defined separately from the contact reception grooves for forcibly receiving the boss of the first half housing; and a set of right angle contacts each comprising a soldering tail portion connected to an intermediate portion connected to a mating portion, wherein the intermediate portions of the contacts are received in the contact reception grooves of the second half housing, while the mating portions and the soldering tail portions respectively extend out from adjacent sides of the second half housing;

wherein at least one cutout is defined in the periphery of the boss of the first half housing allowing the boss to deform during insertion into the reception hole of the second half housing.

2. The connector module as claimed in claim 1, wherein an an inner flange projects from inner periphery of the boss reception hole for preventing the boss of the first half housing from releasing from the boss reception hole of the second half housing.

3. The connector module as claimed in claim 1, wherein the first half housing has at least one engaging protrusion projecting from the inner surface thereof and the second half housing has at least one engaging hole for retaining the engaging protrusion therein when the first half housing is connected to the second half housing.

4. A modular connector comprising:

an insulative mother housing defining rows of passageways through opposite sides thereof;

a plurality of modules each having contacts extending therefrom for connection to the passageways of the mother housing, each module defining a reception hole so that all the reception holes of all the modules are in alignment with each other when the modules are connected to the mother housing by the extended contacts thereof;

a dowel sized to be inserted into the reception holes of at least two adjacent modules thereby connecting the at least two adjacent modules in addition to the connection thereof to the mother housing;

wherein each module comprises an insulative first half housing having a boss extending from an inner surface thereof and a reception hole defined through an axis of the boss, an insulative second half housing having a plurality of contact reception grooves defined in an inner surface thereof, and a reception hole defined separately from the contact reception grooves for forcibly receiving the boss of the first half housing, and a set of right angle contacts each comprising a soldering tail portion connected to an intermediate portion connected to a mating portion, wherein the intermediate portions of the contacts are received in the contact reception grooves of the second half housing, while the mating portions and the soldering tail portions respectively extend out from adjacent sides of the second half housing; and wherein at least one cutout is defined in the periphery of the boss of the first half housing allowing the boss to deform during insertion into the reception hole of the second half housing.

5. The modular connector as claimed in claim 4, wherein the dowel is a hollow cylinder which defines a hole through an axis thereof.

6. The modular connector as claimed in claim 5, wherein the dowel forms in a periphery thereof a longitudinal cutout in communication with the hole.

7. The modular connector as claimed in claim 4, wherein an an inner flange projects from inner periphery of the boss reception hole for preventing the boss of the first half housing from releasing from the boss reception hole of the second half housing.

8. The modular connector as claimed in claim 4, wherein the first half housing has at least one engaging protrusion projecting from the inner surface thereof and the second half housing has at least one engaging hole for retaining the engaging protrusion therein when the first half housing is connected to the second half housing.

* * * * *